US007432031B2

(12) United States Patent
Mizutani et al.

(10) Patent No.: US 7,432,031 B2
(45) Date of Patent: Oct. 7, 2008

(54) TONER FOR ELECTROSTATIC CHARGE DEVELOPING, PRODUCTION METHOD THEREOF, DEVELOPER FOR ELECTROSTATIC CHARGE DEVELOPING USING THE SAME, AND IMAGE FORMING METHOD

(75) Inventors: Noriyuki Mizutani, Kanagawa (JP); Hideo Maehata, Kanagawa (JP); Hirokazu Hamano, Kanagawa (JP); Hiroyuki Tanaka, Kanagawa (JP); Soichiro Kitagawa, Kanagawa (JP); Moegi Iguchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 443 days.

(21) Appl. No.: 11/201,166

(22) Filed: Aug. 11, 2005

(65) Prior Publication Data

US 2006/0216627 A1 Sep. 28, 2006

(30) Foreign Application Priority Data

Mar. 22, 2005 (JP) ..... 2005-082811

(51) Int. Cl.
*G03G 9/00* (2006.01)

(52) U.S. Cl. ..... 430/109.4; 430/111.35; 430/123.5; 430/137.14

(58) Field of Classification Search ..... 430/109.4, 430/111.35, 123.5, 137.14
See application file for complete search history.

(56) References Cited

U.S. PATENT DOCUMENTS 6,346,356 B1 * 2/2002 Ohno et al. ..... 430/108.2
2003/0129516 A1 * 7/2003 Nakamura et al. ..... 430/108.21
2003/0162112 A1 * 8/2003 Yamashita et al. ..... 430/108.6
2003/0219667 A1 * 11/2003 Matsumoto et al. ..... 430/108.7

FOREIGN PATENT DOCUMENTS

| | | |
|---|---|---|
| JP | A-63-282752 | 11/1988 |
| JP | A-05-094043 | 4/1993 |
| JP | A-05-142847 | 6/1993 |
| JP | A-05-313416 | 11/1993 |
| JP | A-06-250439 | 9/1994 |

* cited by examiner

*Primary Examiner*—Mark A Chapman
(74) *Attorney, Agent, or Firm*—Oliff & Berridge, PLC

(57) ABSTRACT

A toner for electrostatic charge developing prepared by a production method including aggregating one or more kind of particles in a raw material dispersion including the particles to form aggregated particles, and coalescing the aggregated particles by heating. At least one kind of the particles is resin particles including an amorphous polyester resin synthesized by copolymerizing one or more polyvalent carboxylic acids and two or more polyhydric alcohols; at least one of the polyvalent carboxylic acids is polyvalent carboxylic acid having a sulfonic acid group; two of the polyhydric alcohols are an ethylene oxide adduct of bisphenol A and a propylene oxide adduct of bisphenol A; and the following equation is satisfied:

$$10/90 \leqq BPA(EO)/BPA(PO) \leqq 90/10.$$

In the equation, BPA(EO) represents a total mole amount of the ethylene oxide adduct of bisphenol A used in synthesis of the amorphous polyester resin, and BPA(PO) represents a total mole amount of the propylene oxide adduct of bisphenol A used in synthesis of the amorphous polyester resin.

21 Claims, No Drawings

TONER FOR ELECTROSTATIC CHARGE DEVELOPING, PRODUCTION METHOD THEREOF, DEVELOPER FOR ELECTROSTATIC CHARGE DEVELOPING USING THE SAME, AND IMAGE FORMING METHOD

CROSS-REFERENCE TO RELATED APPLICATION

This application claims priority under 35 USC 119 from Japanese Patent Application No. 2005-082811, the disclosure of which is incorporated by reference herein.

BACKGROUND OF THE INVENTION

1. Field of the Invention

The present invention relates to a toner for electrostatic charge developing used in a copying machine for forming an image using electrophotography, as well as a developer for electrostatic charge developing using the same, and an image forming method.

2. Description of the Related Art

A method of visualizing image information as an image via an electrostatic charge image such as electrophotography is currently utilized in a variety of fields. In electrophotograhpy, this method is one of forming an image via steps of forming an electrostatic charge image on a photoreceptor by electrification and exposure, developing the electrostatic latent image with a developer containing a toner to form a toner image, and transferring and fixing this toner image onto a recording medium.

As a developer used therein, there are two-component developers including a toner and a carrier, and one-component developers using a magnetic toner or a non-magnetic toner alone. A toner is usually prepared by a kneading-pulverizing method in which a thermoplastic resin together with a pigment, a charge controlling agent, and a releasing agent such as a wax is melted, kneaded, and cooled and, thereafter, this is finely-divided, and classified. In order to improve fluidity and cleanability of this toner, if necessary, inorganic particles or organic particles are added to a surface of toner particles in some cases.

On the other hand, in recent years, with the development of a high information society, demand for the provision of information documents produced by various procedures as an image having high quality has been increased, and study of higher image quality has been advanced in a variety of image forming methods. Also in an image forming method using electrophotography, this demand is not exceptional and, particularly in electrophotography, in order to realize a finer image in color image information, achievement of a reduction in toner particle size and a sharp particle size distribution is demanded.

For example, in an image forming device such as a digital full color copying machine or a printer, a color image manuscript is color-separated with each filter of B (blue), R (red) and G (green), and a latent image of a dot diameter of 20 to 70 μm corresponding to the original manuscript is developed by a subtractive color process using each developer of Y (yellow), M (magenta), C (cyan) and Bk (black).

In this method, as compared with a conventional white and black machine, it is necessary to transfer a larger amount of a developer, and it is also necessary for the method to be applicable to a dot having a smaller diameter. For this reason, in a toner utilized in this method, it becomes increasingly important to maintain uniform electrostatic property including dependency of electrification on environment, retention of uniform electrostatic charge, sharpness in a particle size distribution, and a toner intensity. In addition, when a demand for higher speed and energy saving in these image forming devices is taken into consideration, a toner is required to have fixability at an even lower temperature. In view of these circumstances as well, a toner of a small particle diameter having a sharp particle size distribution is demanded.

However, in the conventional kneading-pulverizing method for preparing a toner via pulverizing and classifying operations, when it is attempted to make a diameter of a toner smaller, a particle diameter which can be actually provided from a viewpoint of economy and performance has a limit of about 8 μm in size.

Currently, a method of preparing a toner having a small particle diameter by various methods has been studied, but in a pulverizing-classifying method, a diameter of particles is only reduced while the previous particle size distribution is retained as it is, and it is difficult to improve the particle size distribution properties. For this reason, when a toner having a smaller diameter is prepared by a kneading-pulverizing method, problems including the occurrence of carrier pollution, photoreceptor pollution, and toner scattering due to the presence of toner of a finer powder side component in a particle size distribution become conspicuous, and it is difficult to realize high image quality and high reliability at the same time.

In recent years, as a means which can intentionally control a shape and an inner structure of toner particles, a toner is extensively prepared, particularly, by a wet process. Specifically, a wet sphering method which can control a toner particle shape, a suspension granulating method which can control a surface structure, and a suspension polymerization or emulsion polymerization aggregation method which can control even an inner structure are being studied. In particular, as a means which can intentionally control a toner particle shape and an inner structure, an emulsion polymerization aggregation method is proposed (for example, see Japanese Patent Application Laid-Open (JP-A) No. 63-282752 and JP-A No. 6-250439, the disclosures of which are incorporated by reference herein).

An emulsion polymerization aggregation method is a method of forming toner particles by mixing a coloring agent dispersion prepared by dispersing a coloring agent in a solvent, in a resin dispersion generally prepared by emulsion polymerization or the like, then, forming aggregated particles corresponding to a toner particle diameter in this mixed solution, and heating this to coalesce the aggregated particles into toner particles.

A more specific process is as follows. First, by generating hetero aggregation in a mixed solution in which a resin dispersion obtained by emulsion polymerization using an ionic surfactant, and a dispersion of a pigment in which the pigment is dispersed with an ionic surfactant having opposite polarity are mixed, aggregated particles of a size of a toner particle diameter are formed. Then, a large amount of an ionic surfactant is added to stop growth of a particle diameter of aggregated particles. Subsequently, toner particles are formed via a coalescing step of heating aggregated particles to a glass transition point of a resin contained in the particles or higher to coalesce the aggregated particles.

In this emulsion polymerization aggregation method, a toner particle shape can be controlled from an indeterminate shape to a spherical shape by selecting a heating temperature condition. The emulsion polymerization aggregation method has the characteristic that a particle size distribution of a toner can be sharpened, and a particle diameter can be reduced and, particularly in the field of color image formation, the method has been studied as a powerful procedure for obtaining a toner, which realizes a highly fine image.

However, upon preparation of a toner, since use of a large amount of a surfactant cannot not be avoided in order to stabilize particles and aggregated particles containing various raw material components in a dispersion, a surfactant remains in a solution containing the toner particles (hereinafter, abbreviated as "toner slurry" in some cases) after completion of a coalescing step.

When a surfactant remains in toner particles, the resulting toner has low electrification and low resistance, leading to occurrence of fog. In particular, adverse effects under high temperature and high humidity are great, and stable developability and transference of the toner cannot be achieved. For this reason, the advantage of the emulsion polymerization aggregation method that a toner having a sharp particle diameter distribution suitable for forming a highly fine image and having a small particle diameter can be obtained, is deteriorated. In addition, pollution of a surface of toner particles with a surfactant reduces fluidity and storability of a toner, leading to reduction in reliability. Therefore, it is required that a surfactant does not remain in toner particles.

Meanwhile, since it is difficult to separate a large amount of a surfactant remaining in a toner slurry, a washing step of washing toner particles obtained via a coalescing step becomes indispensable in a process for preparing a toner utilizing an emulsion polymerization aggregation method.

However, since a conventional washing step has mostly been performed by water washing, it has been impossible to completely remove a surfactant adhered to a surface of toner particles. In addition, when it is attempted to decrease an amount of a surfactant adhered to a surface of toner particles as much as possible, not only does an amount of water necessary for washing become enormous, but also the increase in a washing water amount influences cost.

As a washing method other than such water washing, a method utilizing alkali washing is proposed (see JP-A No. 5-142847, the disclosure of which is incorporated by reference herein). According to this method, it is presumed that solubility of a surfactant adhered to a surface of toner particles in washing water is certainly enhanced by an alkali, and thereby cleanability is enhanced. However, since an excessive alkali component remains on a surface of toner particles, a problem arises in that a toner particle size is destabilized, an electrification level is reduced, and a particle sized distribution is expanded. In order to solve these problems, it becomes necessary to additionally perform water washing after the alkali washing, which is also a problem with regard to a number of steps, time and cost.

Besides an emulsion polymerization aggregation method, a method of utilizing a surfactant as a dispersant is also known in toner preparing methods such as suspension polymerization, suspension granulation, and wet sphering (for example, see JP-A No. 5-313416, the disclosure of which is incorporated by reference herein). However, an amount of a dispersant used in these methods is small, and most of the dispersant is adhered to a toner particle surface. For this reason, surfactant that remains in an interior or on a surface of toner particles after a step of washing toner particles is of such a small amount that problems such as the aforementioned deterioration in electrostatic properties do not arise.

As a resin (binder resin) for a toner, which has been used frequently in recent years, a polyester resin is more preferably used than a vinyl-based polymer, a representative of which is a styrene-acryl copolymer, from a viewpoint of low temperature fixability and fixing strength. In particular, a polyester resin is more preferably used as a resin for a color toner from a viewpoint of transparency as well.

When a toner is prepared utilizing an emulsion polymerization aggregation method, a polyester resin can be used as a resin for the toner. Such a polyester resin can be synthesized from polyvalent carboxylic acid also having a sulfonic acid group, and a polyhydric alcohol such as an alkylene oxide adduct of hydrogenated bisphenol A (for example, see JP-A No. 5-94043, the disclosure of which is incorporated by reference herein).

However, when the aforementioned alkali washing is utilizing in order to wash and remove a surfactant adhered to toner particles, this leads to hydrolysis of a polyester resin itself contained in the toner. For this reason, problems such as reduction in an electrification level of the toner, reduction in strength of the toner, and expansion of a particle size distribution of the toner arise.

SUMMARY OF THE INVENTION

The present invention has been made in view of the aforementioned circumstances. That is, the invention provides a toner for electrostatic charge developing which can form an image having no fog and excellent resolution over a long period of time by suppressing an amount of a surfactant to be used to an amount that is smaller than that conventionally used to make a particle size distribution of a toner sharp when a toner is prepared by a so-called emulsion polymerization aggregation method utilizing an amorphous polyester resin as a binder resin, a production method thereof, a developer for electrostatic charge developing using the same, and an image forming method.

The present inventors thought that a procedure of optimizing a washing step would be difficult as described above, and thought that it is important to suppress an amount of a surfactant itself contained in a toner slurry after a coalescing step which is a subject of washing treatment.

On the other hand, in an emulsion polymerization aggregation method, in addition to a resin particle dispersion in which a resin particle is dispersed, a dispersion is prepared for every component constituting a toner, such as a coloring agent dispersion in which a coloring agent is dispersed as particles, and a releasing agent dispersion in which a releasing agent is dispersed as particles. These particle dispersions are mixed to prepare a raw material dispersion, subsequently, various particles are aggregated in the raw material dispersion to form aggregated particles, and these are coalesced to obtain a toner slurry containing toner particles.

Herein, in various particle dispersions, a surfactant is utilized for maintaining dispersion stability of particles.

For this reason, in order to suppress an amount of a surfactant contained in a toner slurry to an amount that is smaller than that conventionally used, it is important to suppress an amount of a surfactant to be used upon preparation of a particle dispersion, and particularly, it is important to reduce an amount of a surfactant contained in a resin particle dispersion using a relatively larger amount of a surfactant than other dispersions, upon preparation of a raw material dispersion. On the other hand, resin particles are required to be stably dispersed in a resin particle dispersion or a raw material dispersion until the formation of aggregated particles, and upon formation of aggregated particles, aggregating property is necessary.

Therefore, the present inventors thought that it is necessary to use resin particles including a resin component in which dispersion stability before aggregation can be maintained even when an amount of a surfactant at preparation of a resin particle dispersion to be used is zero or extremely small, and in which aggregating property at aggregation can also be realized, and thereby achieved the following invention.

That is, a first aspect of the invention is to provide a toner for electrostatic charge developing prepared by a production method comprising aggregating one or more kinds of particles in a raw material dispersion including the particles to form aggregated particles, and coalescing the aggregated particles by heating, wherein at least one kind of the particles is resin particles including an amorphous polyester resin synthesized by copolymerizing one or more polyvalent carboxylic acids and two or more polyhydric alcohols; at least one of the polyvalent carboxylic acids is a polyvalent carboxylic acid having a sulfonic acid group; two of the polyhydric alcohols are an ethylene oxide adduct of bisphenol A and a propylene oxide adduct of bisphenol A; and the following equation (1) is satisfied:

$$10/90 \leqq BPA(EO)/BPA(PO) \leqq 90/10 \quad \text{Equation (1)}$$

wherein, BPA(EO) represents a total mole amount of the ethylene oxide adduct of bisphenol A used in synthesis of the amorphous polyester resin, and BPA(PO) represents a total mole amount of the propylene oxide adduct of bisphenol A used in synthesis of the amorphous polyester resin.

A second aspect of the invention is to provide a developer for electrostatic charge developing, which comprises the toner for electrostatic charge developing of the first aspect of the invention, and a carrier covered with a resin.

A third aspect of the invention is to provide an image forming method comprising: forming an electrostatic latent image on a latent image holding member surface; developing the electrostatic latent image formed on the latent image holding member surface with a developer held by a developer holding member to form a toner image; transferring the toner image formed on the latent image holding member surface onto a recording medium surface; and thermally fixing the toner image transferred onto the recording medium surface, wherein the developer is the developer for electrostatic charge developing of the second aspect of the invention.

A fourth aspect of the invention is to provide a method for producing a toner for electrostatic charge developing comprising: aggregating one or more kinds of particles in a raw material dispersion including the particles to form aggregated particles, and coalescing the aggregated particles by heating, wherein at least one kind of the particles is resin particles including an amorphous polyester resin synthesized by copolymerizing one or more polyvalent carboxylic acids and two or more polyhydric alcohols, at least one of the polyvalent carboxylic acids is a polyvalent carboxylic acid having a sulfonic acid group, two of the polyhydric alcohols are an ethylene oxide adduct of bisphenol A and a propylene oxide adduct of bisphenol A, and the following equation (1) is satisfied $$10/90 \leqq BPA(EO)/BPA(PO) \leqq 90/10 \quad \text{Equation (1)}$$

wherein BPA(EO) represents a total mole amount of the ethylene oxide adduct of bisphenol A used in synthesis of the amorphous polyester resin, and BPA (PO) represents a total mole amount of the propylene oxide adduct of bisphenol A used in synthesis of the amorphous polyester resin.

DETAILED DESCRIPTION OF THE INVENTION

<Toner for Electrostatic Charge Developing>

The toner for electrostatic charge developing of the present invention (hereinafter, abbreviated as "toner" in some cases) is a toner for electrostatic charge developing which is prepared by a producing method comprising an aggregating step of aggregating one or more kinds of particles in a raw material dispersion including the particles to form aggregated particles, and a coalescing step of coalescing the aggregated particles by heating. At least one kind of the particles is resin particles including an amorphous polyester resin synthesized by copolymerizing one or more polyvalent carboxylic acids and two or more polyhydric alcohols. At least one of the polyvalent carboxylic acids is a polyvalent carboxylic acid having a sulfonic acid group, and two of the polyhydric alcohols are an ethylene oxide adduct of bisphenol A and a propylene oxide adduct of bisphenol A. Furthermore, the following equation (1) is satisfied.

$$10/90 \leqq BPA(EO)/BPA(PO) \leqq 90/10 \quad \text{Equation (1)}$$

In the equation (1), BPA(EO) represents a total mole amount of the ethylene oxide adduct of bisphenol A used in synthesis of the amorphous polyester resin, and BPA(PO) represents a total mole amount of the propylene oxide adduct of bisphenol A used in synthesis of the amorphous polyester resin.

A polyester resin used in the toner of the invention is generally synthesized by copolymerizing by dehydration-condensation of polyvalent carboxylic acid such as dicarboxylic acid and polyhydric alcohol such as diol.

Herein, in the invention, even when a use amount of a surfactant upon preparation of resin particles in which resin particles including an amorphous polyester resin are dispersed is considerably reduced or reduced to zero by using a polyvalent carboxylic acid having a sulfonic acid group as a polyvalent carboxylic acid, dispersion stability of resin particles in a resin particle dispersion, or in a raw material dispersion before aggregation treatment used in an aggregating step, can be maintained as in a conventional case where a large amount of a surfactant is used.

In particular, when a pH adjusting agent is added to bring a pH of a raw material dispersion into an acidic region of around 3.5 after a resin particle dispersion and other particle dispersion are mixed in an aggregating step, since dissociation of hydrogen of a carboxyl group originally possessed by an amorphous polyester resin is suppressed, hydrophobicity of the amorphous polyester resin is increased. For this reason, only resin particles are aggregated before resin particles are hetero-aggregated with other particles to form aggregated particles, and preparation of a toner itself becomes impossible.

However, since the polyvalent carboxylic acid containing a sulfonic acid group is used for synthesis of the amorphous polyester resin used in the invention, a sulfonic acid group is contained in a resin in addition to a carboxyl group. Since in this sulfonic acid group, hydrogen remains dissociated in a pH region where a pH is lower by around 1.5, a surface of resin particles can be kept in the hydrophilic state. For this reason, resin particles can be stably present in a raw material dispersion without aggregation until aggregating treatment for forming aggregated particles is performed.

In the case where an amount of a sulfonic acid group contained in an amorphous polyester resin is small, when a pH of a resin particle dispersion or a raw material dispersion is low, resin particles cannot sufficiently exert hydrophilicity, and dispersion stability may be easily reduced. For this reason, upon preparation of a resin particle dispersion, it may become necessary to use a surfactant to some extent in order to maintain dispersion stability, in some cases.

However, as compared with the case where a sulfonic acid group is not contained in an amorphous polyester resin, by introducing even a small amount of a sulfonic acid group into an amorphous polyester resin, a use amount of a surfactant upon preparation of a resin particle dispersion can be considerably decreased. For this reason, reduction in electrification of a toner can be prevented, and occurrence of fog can be prevented.

From such a point of view, a ratio of polyvalent carboxylic acid having a sulfonic acid group relative to a total amount of polyvalent carboxylic acid and polyhydric alcohol used in synthesis of the amorphous polyester resin is preferably 0.1 mol % or more, and more preferably 0.3 mol % or more. In this case, since dispersion stability of resin particles can be sufficiently maintained even when a surfactant is not used upon preparation of a resin particle dispersion, consequently, a total amount of a surfactant in a toner slurry can be reduced.

When the ratio is less than 0.1 mol %, an amount of surfactant can be reduced as compared with the previous cases, but it may become necessary to use a surfactant in some cases, even if the amount is small.

On the other hand, when an amount of a sulfonic acid group contained in the amorphous polyester resin is large, since hydrophilicity of resin particles themselves is increased, dispersion stability of resin particles in a resin particle dispersion or a raw material dispersion can be improved. However, since hydrophilicity of the finally obtained toner is also increased, particularly in a high humidity environment, moisture in the air may be adsorbed onto a toner, leading to reduction in electrification or deterioration of transferring property in some cases.

From such a point of view, a ratio of polyvalent carboxylic acid having a sulfonic acid group relative to a total amount of polyvalent carboxylic acid and polyhydric alcohol used in synthesis of the amorphous polyester resin is preferably 5 mol % or less, and more preferably 4.5 mol % or less. When the ratio exceeds 5 mol % as described above, this may result in reduction in electrification or deterioration of transferring property in some cases.

On the other hand, when an amorphous polyester resin with a sulfonic acid group introduced therein is used in order to maintain and improve dispersion stability of resin particles in a resin particle dispersion or a raw material dispersion, formation of aggregated particles is inhibited in an aggregating step. For this reason, it is necessary to maintain dispersion stability of resin particles and, at the same time, also realize aggregating property in an aggregating step.

The present inventors intensively studied this point and, as a result, found out that it is effective to use both of an ethylene oxide adduct of bisphenol A and a propylene oxide adduct of bisphenol A as polyhydric alcohols used in synthesis of the amorphous polyester resin. Further, it was found that a sharp particle size distribution, which contributes to improvement in resolution of an image and a highly fine image, is obtained at the same time.

This is because the sulfonic acid group contained in the amorphous polyester resin controls an extent of hydrophilicity-hydrophobicity of a resin due to a variation in a pH to maintain dispersion stability of resin particles in a low pH region, while by using a prescribed ratio of an ethylene oxide adduct of bisphenol A and a propylene oxide adduct of bisphenol A, aggregating property can be controlled without being influenced by a pH of a raw material dispersion.

The mechanism of this action is presumed to be as follows.

That is, since the ethylene oxide adduct of bisphenol A governs hydrophilicity, while the propylene oxide adduct of bisphenol A governs hydrophobicity, when both are used at a prescribed ratio upon synthesis of the amorphous polyester resin, balance between hydrophilicity and hydrophobicity of the amorphous polyester resin can be controlled. In addition, since both of the ethylene oxide adduct of bisphenol A and the propylene oxide adduct of bisphenol A are nonionic, controlling of balance between hydrophilicity and hydrophobicity is not influenced by a variation in pH.

Therefore, it is thought that, by adjusting a ratio of the ethylene oxide adduct of bisphenol A and the propylene oxide adduct of bisphenol A used upon synthesis of the amorphous polyester resin, mild aggregating property between resin particles and between other particles and resin particles, and a sharp particle size distribution when prepared into a toner can be maintained.

From the above-described point of view, it is necessary that a ratio of the ethylene oxide adduct of bisphenol A and the propylene oxide adduct of bisphenol A used in synthesis of the amorphous polyester resin satisfies the following equation (1).

$$10/90 \leqq BPA(EO)/BPA(PO) \leqq 90/10 \qquad \text{Equation (1)}$$

In the equation (1), BPA(EO) represents a total mole amount of the ethylene oxide adduct of bisphenol A used in synthesis of the amorphous polyester resin, and BPA(PO) represents a total mole amount of the propylene oxide adduct of bisphenol A used in the synthesis of the amorphous polyester resin.

The value "BPA(EO)/BPA(PO)" shown in the equation (1) is a so-called mole ratio, and is preferably $20/80 \leqq BPA(EO)/BPA(PO) \leqq 90/10$, and more preferably $25/75 \leqq BPA(EO)/BPA(PO) \leqq 85/15$.

In a case where $90/10 < BPA(EO)/BPA(PO)$, hydrophilicity of the amorphous polyester resin is strengthened, and aggregation proceeds with difficulty, whereby it becomes difficult to control a particle diameter of a toner. On the other hand, in a case where $10/90 > BPA(EO)/BPA(PO)$, hydrophilicity of the amorphous polyester resin is strengthened, and an aggregation rate is elevated, whereby uniform aggregated particles cannot be formed and, consequently, a sharp particle size distribution cannot be obtained.

In addition, a use amount of a bisphenol A component of both of the bisphenol A ethylene oxide adduct and the propylene oxide adduct used upon synthesis of the amorphous polyester resin is not particularly limited, but in order to effectively manifest the aforementioned effect, the amount is preferably 50 mol % or more, and more preferably 60 mol % or more, relative to a total amount of a polyhydric alcohol component used in the synthesis.

An amount of ethylene oxide and propylene oxide to be added to bisphenol A is not particularly limited, but usually, addition of 1 mol or 2 mol per 1 mol of bisphenol A is preferable.

—Binder Resin (Amorphous Polyester Resin)—

Next, raw materials, a production method, and physical properties of the amorphous polyester resin used in the invention, as well as a resin particle dispersion using this will be explained in more detail.

Upon synthesis of the amorphous polyester resin used in the invention, one or more polyvalent carboxylic acids and two or more polyhydric acids are used. Herein, regarding the former, at least one polyvalent carboxylic acid having a sulfonic acid group is necessarily used, and other polyvalent carboxylic acids can be used if necessary.

Regarding the latter, two kinds, an ethylene oxide adduct of bisphenol A and a propylene oxide adduct of bisphenol A, are necessarily used, and other polyhydric alcohols can be used if necessary.

The polyvalent carboxylic acid having a sulfonic acid group is not particularly limited, and the known ones can be utilized. Examples are not limited to, but include a sodium salt of 2-sulfoterephthalic acid, a sodium salt of 5-sulfoisophthalic acid, and a sodium salt of sulfosuccinic acid. In addition, a lower alkyl ester, and an acid anhydride of them may be utilized. Among them, a sodium salt of 5-sulfoisophthalic acid is preferable from a viewpoint of a cost.

Besides, polyvalent carboxylic acids and polyhydric alcohols other than the aforementioned essential components constituting a polyester resin are not particularly limited, and the known ones can be used.

Examples of polyvalent carboxylic acid include aromatic carboxylic acids such as terephthalic acid, isophthalic acid, phthalic acid anhydride, trimellitic acid anhydride, pyromellitic acid, and naphthalenedicarboxylic acid, aliphatic carboxylic acids such as maleic acid anhydride, fumaric acid, succinic acid, alkenylsuccinic acid anhydride, and adipic acid, and alicycilic carboxylic acids such as cyclohexanedicarboxylic acid.

One or more kinds of these polyvalent carboxylic acids can be used, if necessary. Among these polyvalent carboxylic acids, aromatic carboxylic acids are preferable. In addition, in order to form a crosslinked structure or a branched structure for securing good fixability, a tri- or more-valent carboxylic acid (for example, trimellitic acid and anhydride thereof) together with a dicarboxylic acid can be used.

As a polyhydric alcohol other than an ethylene oxide adduct of bisphenol A and a propylene oxide adduct of bisphenol A, the known ones can be utilized. For example, aliphatic diols such as ethylene glycol, diethylene glycol, triethylene glycol, propylene glycol, butanediol, hexanediol, neopentyl glycol, and glycerin; alicyclic diols such as cyclohexanediol, cyclohexanedimethanol, and hydrogenated bisphenol A; aromatic diols such as bisphenol A can be utilized. One or more kinds of these polyhydric alcohols can be used.

Among these polyhydric alcohols, aromatic diols, and alicyclic diols are preferable. In order to form a crosslinked structure or a branched structure for securing good fixability, a tri- or more-hydric alcohol (glycerin, trimethylolpropane, pentaerythritol) together with a diol may be used.

In addition, a monocarboxylic acid and/or monoalcohol may be further added to an amorphous polyester resin obtained by polycondensation of polyvalent carboxylic acid and polyhydric alcohol to esterify a hydroxyl group and/or a carboxyl group at a terminal of a polymer to adjust an acid value of an amorphous polyester resin.

Examples of monocarboxylic acid include acetic acid, acetic acid anhydride, benzoic acid, trichloroacetic acid, trifluoroacetic acid, and propionic acid anhydride, and examples of monoalcohol include methanol, ethanol, propanol, octanol, 2-ethylhexanol, trifluoroethanol, trichloroethanol, hexafluoroisopropanol, and phenol.

A process for preparing an amorphous polyester resin is not particularly limited, but an amorphous polyester resin can be prepared by a general polyester polymerizing method in which an acid component and an alcohol component are reacted. For example, an amorphous polyester resin can be prepared by using a method such as direct polycondensation or transesterification depending on a kind of a monomer utilized in the synthesis. A mole ratio (acid component/alcohol component) upon a reaction of the acid component and the alcohol component is different depending on reaction condition, and is usually about 1/1 although it cannot be said always.

Preparation of an amorphous polyester resin can be performed at a polymerization temperature between 180 and 230° C., and a reaction is performed, if necessary, in a reaction system under reduced pressure, while water and alcohol produced at condensation are removed. When a monomer is not dissolved or is not compatible under a reaction temperature, a solvent having a high boiling point is added as a solubilizer to dissolve the monomer.

A polycondensation reaction is performed while a solubilizer is distilled off. When a monomer having worse compatibility is present in a copolymerization reaction, after a monomer having worse compatibility and an acid component or an alcohol component which is to be polycondensed with the monomer are condensed in advance, this may be polycondensed with a main component.

Examples of a catalyst usable at preparation of an amorphous polyester resin include alkali metal compounds such as sodium, and lithium, alkaline earth metal compounds such as magnesium, and calcium, metal compounds such as zinc, manganese, antimony, titanium, tin, zirconium, and germanium phosphorus compounds, phosphate compounds, and amine compounds. Specifically, examples include the following compounds.

Examples include compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl) phosphite, ethyltriphenylphosphonium bromide, triethylamine, and triphenylamine.

An amorphous polyester resin used in the toner of the invention has a weight average molecular weight (Mw) as measured by a gel permeation chromatography (GPC) method of a tetrahydrofuran (THF)-soluble matter, preferably of 5,000 to 500,000, more preferably 7,000 to 100,000. A number average molecular weight (Mn) is preferably 2,000 to 10,000, and a molecular weight distribution (Mw/Mn) is preferably 1.5 to 50, more preferably 1.8 to 30.

When a weight average molecular weight and a number average molecular weight are smaller than the aforementioned range, although low temperature fixability is effected, not only is hot offset resistance deteriorated, but also a glass transition point of a toner is lowered, whereby storability such as blocking of a toner may be adversely influenced in some cases.

On the other hand, when a weight average molecular weight and a number average molecular weight are larger than the aforementioned range, although hot offset resistance can be sufficiently imparted, fixability at a low temperature may be deteriorated, and much heat energy may become necessary at fixation in some cases. Therefore, by satisfying the aforementioned condition, it becomes easy to realize both of low temperature fixability and hot offset resistance.

In the invention, a molecular weight of a resin is obtained by measuring a THF-soluble matter in a THF solvent employing GPC HLC-8120 (trade name) manufactured by Tosoh Corporation and a column TSKgel SuperHM-M (15 cm) (trade name) manufactured by Tosoh Corporation, and calculating a molecular weight using a molecular weight calibration curve produced by monodisperse polystyrene standard samples.

Details of a method for producing the toner of the invention will be described later, and the aforementioned amorphous polyester resin is used for a resin particle dispersion in which the resin is dispersed as particles, upon preparation of the toner.

This resin particle dispersion is formed by giving a shearing force to a solution in which an aqueous medium, and a mixed solution (polymer solution) containing a polyester resin and, if necessary, a coloring agent are mixed. Thereupon, by heating to a temperature of a softening point of an amorphous polyester resin or higher, a viscosity of a polymer solution can be lowered to form a resin particle dispersion.

Upon preparation of a resin particle dispersion, in the case of conventional binder resin, it is necessary to use a surfactant as a dispersant in an amount of about 1 to 5% by weight. However, in the case of the aforementioned amorphous polyester resin, a surfactant is not substantially necessary and, even when an introduction amount of the sulfonic acid group contained in an amorphous polyester resin is small, and it is desirable to use a surfactant, an amount of the surfactant may be small, and may be 0.5% by weight or less.

Examples of a dispersing machine used upon formation of a resin particle dispersion include a homogenizer, a homomixer, a pressure kneader, an extruder, and a media dispersant machine. A size of particles of an amorphous polyester resin is preferably 0.005 to 0.5 μm, more preferably 0.01 to 0.3 μm as expressed by its average particle diameter (volume average particle diameter D50v). When the particle diameter is smaller than 0.005 μm, since most of the resin particles are dissolved in water, it may become difficult to prepare a resin particle dispersion. On the other hand, when the particle diameter is 0.5 μm or more, it may become difficult to obtain toner particles of 3.0 to 7.5 μm, which is a desired particle diameter of toner.

An average particle diameter of resin particles can be measured, for example, by a Doppler scattering-type particle size distribution measuring apparatus (trade name: MICROTRACK UPA9340, available from Nikkiso Co., Ltd.) or a laser diffraction-type particle size distribution measuring apparatus (trade name: LA-700, manufactured by Horiba, Ltd.).

When a melt viscosity of an amorphous polyester resin at dispersing is high, a resin is not miniaturized to a desired particle diameter. In such a case, a dispersion of resin particles of a desired particle diameter can be obtained by raising a temperature using a dispersing apparatus to which a pressure larger than the atmospheric pressure can be applied, and dispersing a resin in the state where a viscosity of a resin is lowered.

In the toner of the invention, as a binder resin, a binder resin other than an amorphous polyester resin can be also used, if necessary. For example, the known binder resins such as a crystalline polyester resin can be utilized. However, when these binder resins are used, a large amount of a surfactant must be used as a dispersant upon preparation of a resin particle dispersion. Therefore, a ratio of a binder resin other than an amorphous polyester resin relative to a total binder resin is preferably 40% by weight or less.

—Coloring Agent—

As a coloring agent used in the toner of the invention, the known coloring agents can be used.

Examples of a yellow pigment include chrome yellow, zinc yellow, yellow iron oxide, cadmium yellow, chrome yellow, Hansa yellow, Hansa yellow 10G, benzidine yellow G, benzidine yellow GR, threne yellow, quinoline yellow, and permanent yellow NCG. Particularly, C.I. Pigment yellow 17, C.I.Pigment yellow 74, C.I.Pigment yellow 97, C.I.Pigment yellow 180, C.I.Pigment yellow 185, and the like are preferably used.

Examples of a magenta pigment include iron oxide red, cadmium red, red lead, mercury sulfide, Watchung red, permanent red 4R, lithol red, brilliant carmine 3B, brilliant carmine 6B, Dupont oil red, pyrazolone red, rhodamine B lake, lake red C, rose bengal, eosine red, and alizarin lake. Examples of a naphthol-based pigment include Pigment red 31, 146, 147, 150, 176, 238, and 269, and examples of a quinacridone-based pigment include Pigment red 122, 202, and 209. Among them, from a viewpoint of manufacturing property, and electrostatic property, Pigment red 185, 238, 269, and 122 is preferable.

Examples of a cyan pigment include Prussian blue, cobalt blue, alkali blue lake, Victoria blue lake, fast sky blue, indanthrene blue BC, aniline blue, ultramarine blue, chlaco oil blue, methylene blue chloride, phthalocyanine blue, phthalocyanine green, and malachite green oxalate. Particularly, C.I.Pigment blue 15:1, C.I.Pigment blue 15:3 and the like are preferably used.

Examples of an orange pigment include red chromo yellow, molybdenum orange, permanent orange GTR, pyrazolone orange, Vulcan orange, benzidine orange G. indanthrene brilliant orange RK, and indanthrene brilliant orange GK.

Examples of a violet pigment include manganese violet, fast violet B, and methylviolet lake. Examples of a green pigment include chromium oxide, chrome green, Pigment green, malachite green lake, and final yellow green G.

Examples of a white pigment include zinc white, titanium oxide, antimony white, and zinc sulfide.

Examples of a extender include barite powder, barium carbonate, clay, silica, white carbon, talc, and alumina white. In addition, various dyes such as acridine series, xanthene series, azo series, benzoquinone series, azine series, anthraquinone series, thioindigo series, dioxazine series, thiazine series, azomethine series, indigo series, thioindigo series, phthalocyanine series, aniline black series, polymethine series, triphenylmethane series, diphenylmethane series, thiazine series, thioazole series, and xanthene series are also used. These coloring agents are used alone, or by mixing them.

Examples of a black pigment include carbon black, copper oxide, manganese dioxide, aniline black, and active carbon. Particularly, carbon black is preferably used. Since carbon black has relatively better dispersing property, special dispersing is not necessary, but it is preferable that carbon black is prepared by the same process as that of a color coloring agent.

A coloring agent used in the toner of the invention is selected from a viewpoint of a hue angle, saturation, brightness, weather resistance, OHP permeability, and dispersibility in the toner. And, a coloring agent can be added in a range of 4 to 15% by weight relative to a weight of a total solid components of the toner.

When a magnetic material is used as a black coloring agent, it can be add at 12 to 240% by weight unlike other coloring agent. Specifically, a material, which is magnetized in a magnetic field, and a ferromagnetic powder such as iron, cobalt, and nickel, or a compound such as ferrite, and magnetite are used. When a toner is obtained in an aqueous phase, an attention must be paid to aqueous phase transferring property of a magnetic material. Preferably, a surface of a magnetic material is modified, for example, the surface is subjected to hydrophobicization treatment.

Upon preparation of the toner of the invention, a coloring agent is used as a coloring agent dispersion in which this is dispersed as particles. Herein, as a dispersant of coloring agent particles for dispersing in a coloring agent dispersion, a surfactant is generally used.

Preferable examples of a surfactant include anionic surfactants such as sulfate salt series, sulfonate salt series, phosphate series, and soap; cationic surfactants such as amine salt type, and quaternary ammonium salt type; nonionic surfactants such as polyethylene glycol series, alkylphenol ethylene oxide adduct series, and polyhydric alcohol series.

Among them, ionic surfactants are preferable, and anionic surfactants, and cationic surfactants are more preferable. It is preferable that the nonionic surfactant is used together with the anionic surfactant or cationic surfactant. Surfactants may be used alone, or in combination of two or more. In addition, it is preferable that surfactants have the same polarity as that of a dispersant used in other dispersion.

Examples of the anionic surfactants include fatty acid soaps such as potassium laurate, sodium oleate, and sodium castor oil; sulfate esters such as octyl sulfate, lauryl sulfate, lauryl ether sulfate, and nonyl phenyl ether sulfate; sulfonate salts such as lauryl sulfonate, dodecyl sulfonate, dodecyl benzene sulfonate, sodium alkylnaphthalenesulfonate (for example, triisopropylnaphthalene sulfonate or dibutylnaphthalene sulfonate), naphthalene sulfonate formalin condensate, monooctyl sulfosuccinate, dioctyl sulfosuccinate, lauric acid amide sulfonate, and oleic acid amide sulfonate; phosphate esters such as lauryl phosphate, isopropyl phosphate, and nonyl phenyl ether phosphate; sulfosuccinate salts such as sodium dialkylsulfosuccinate (for example, sodium dioctylsulfosuccinate), disodium lauryl sulfosuccinate, and disodium lauryl polyoxyethylene sulfosuccinate.

Examples of the cationic surfactant include amine salts such as laurylamine hydrochloride, stearyl amine hydrochloride, oleylamine acetate, stearylamine acetate, and stearylaminopropylamine acetate; quaternary ammonium salts such as lauryltrimethylammonium chloride, dilauryldimethylammonium chloride, distearylammonium chloride, distearyldimethylammonium chloride, lauryldihydroxyethylmethylammonium chloride, oleylbispolyoxyethylenemethylammonium chloride, lauroylaminopropyldimethylethylammonium etosulfate, lauroylaminopropyldimethylhydroxyethylammonium perchlorate, alkylbenzenedimethylammonium chloride, and alkyltrimethylammonium chloride.

Examples of the nonionic surfactant include alkyl ethers such as polyoxyethylene octyl ether, polyoxyethylene lauryl ether, polyoxyethylene stearyl ether, and polyoxyethylene oleyl ether; alkyl phenyl ethers such as polyoxyethylene octyl phenyl ether, and polyoxyethylene nonyl phenyl ether; alkyl esters such as polyoxyethylene laurate, polyoxyethylene stearate and polyoxyethylene oleate; alkylamines such as polyoxyethylene laurylaminoether, polyoxyethylene stearylaminoether, polyoxyethylene oleylaminoether, polyoxyethylene soybean aminoether, and polyoxyethylene tallow aminoether; alkylamides such as polyoxyethylene lauric acid amide, polyoxyethylene stearyl acid amide, and polyoxyethylene oleic acid amide; vegetable oil ethers such as polyoxyethylene castor oil ether, and polyoxyethylene rapeseed oil ether; alkanol amides such as lauric acid diethanolamide, stearic acid diethanol amide, and oleic acid diethanol amide; sorbitan ester ethers such as polyoxyethylene sorbitan monolaurate, polyoxyethylene sorbitan monopalmitate, polyoxyethylene sorbitan monostearate, and polyoxyethylene sorbitan monooleate.

An addition amount of a dispersant to be used is preferably 2 to 30% by weight, and more preferably 5 to 20% by weight, relative to a coloring agent. When an amount of a dispersant is too small, a particle diameter of coloring agent particles may not be reduced in some cases, and storage stability of a coloring agent dispersion may be deteriorated in some cases. On the other hand, when the amount is too large, an amount of a dispersant remaining in a toner may be increased, and electrostatic property and powder fluidity of a toner may be reduced in some cases.

It is preferable that an aqueous dispersed medium used upon preparation of a coloring agent dispersion is a medium in which an amount of impurities such as metal ions is small, such as distilled water or ion-exchanged water. In addition, for antifoaming and adjusting a surface tension, an alcohol may be added. In addition, for adjusting a viscosity, a polyvinyl alcohol or a cellulose-based polymer may be added.

—Releasing Agent—

The toner of the invention may contain a releasing agent for the purpose of improving fixability and image storability.

A releasing agent to be used is preferably a substance having a maximum main endothermic peak measured according to ASTM D3418-8, the disclosure of which is incorporated by reference herein, at 60 to 120° C. and having a melt viscosity of 1 to 50 mPa·s at 140° C. When a melting point is lower than 60° C., a temperature for change of a releasing agent is too low, a blocking resistance may be deteriorated and, when a temperature in an image forming device is elevated, developability may be deteriorated in some cases. On the other hand, when a melting point exceeds 120° C., a temperature for change of a wax is too high. Although toner may be fixed by fixation at a high temperature, this is not desirable from a viewpoint of energy saving in some cases.

In addition, at a melt viscosity higher than 50 mPa·s, elution from a toner is weak, and fixation peelability becomes insufficient in some cases.

A viscosity of a releasing agent is measured by an E-type viscometer. Upon measurement, an E-type viscometer provided with an oil circulating-type constant temperature bath (manufactured by Tokyo Keiki Co., Ltd.) is used. For measurement, a plate of a combination of a cone plate/a cup having a cone angle of 1.34 degree is used. A sample is placed into a cup, a temperature of a circulating device is set at 140° C., a vacant measuring cup and a cone are set in a measuring device, and a temperature is retained constant while an oil is circulated. When a temperature is stabilized, 1 g of a sample is placed in a measuring cup, and a cone is allowed to stand for 10 minutes in a stationary state. After stabilization, a cone is rotated, and measurement is performed. A rotation rate of a cone is 60 rpm. Measurement is performed three times, and an average thereof is adopted as a viscosity $\eta$. It is desirable that the releasing agent has an endothermic initiation temperature of 40° C. or higher in a DSC curve measured with a differential scanning calorimeter. More preferably, the temperature is 50° C. or higher. When the temperature is lower than 40° C., aggregation of toners may occur in a copying machine or a toner bottle, in some cases.

An endothermic initiation temperature depends on low molecular weight components, and a kind and an amount a polar group possessed by the structure of the low molecular weight component, among a molecular weight distribution constituting a wax. Generally, at a higher molecular weight, a melting point, at the same time, an endothermic initiation temperature are elevated, but by this way, a low melting temperature and a low viscosity originally possessed by a wax are deteriorated. Therefore, it is effective to select and remove only these low molecular weights among a molecular weight distribution of a wax, and examples of this method include a method such as molecular distillation, solvent fractionation, and gas chromatography separation.

In addition, when a maximum endothermic peak is below 50° C., offset may be easily caused at fixation. Conversely, when the peak exceeds 140° C., a fixing temperature becomes high, smoothness of a fixed image surface may not be obtained, and gloss property may be deteriorated. Measurement of DSC is performed, for example, using DSC-7 (trade name, manufactured by Perkin Elmer. For correcting a temperature at a detection part of a device, melting points of indium and zinc are used and, for correcting a quantity of heat, melting heat of indium is used. A sample is measured at a temperature raising rate of 10° C./min by using an aluminum pan, and setting a vacant pan as a control.

Examples of a releasing agent which can be used in the toner of the invention include low-molecular polyolefins such as polyethylene, polypropylene, and polybutene, silicones exhibiting a softening point by heating, fatty acid amides such as oleic acid amide, erucic acid amide, ricinoleic acid amide, and stearic acid amide, vegetable waxes such as carnauba wax, rice wax, candelilla wax, Japan wax, and jojoba oil, animal waxes such as beewax, mineral-petroleum waxes such as montan wax, ozokerite, ceresin, paraffin wax, microcrystalline wax, and Fischer Tropsch wax, and modifications of them.

Upon preparation of the toner of the invention, a releasing agent is used as a releasing agent dispersion in which the releasing agent is dispersed as particles.

A releasing agent dispersion is prepared by dispersing a releasing agent together with an ionic surfactant, a polymer electrolyte such as a polymer acid or a polymer base in water, heating to a melting point of a releasing agent or higher and, at the same time, dispersing in a particle form with a homogenizer having the strong shear imparting ability, or a pressure discharging-type dispersing machine (Gaulin homogenizer, manufactured by Gaulin). A particle diameter of a releasing agent dispersion is measured, for example, with a Doppler scattering-type particle diameter distribution measuring device or a laser diffraction-type particle diameter distribution measuring device (trade name: LA-700, manufactured by Horiba Ltd.).

A releasing agent used in the toner of the invention is preferably such that a ratio of a dispersant relative to the releasing agent in a releasing agent dispersion is 1 to 20% by weight. More preferably, the ratio is 2 to 10% by weight. When the ratio of the dispersant is too small, a releasing agent may not be sufficiently dispersed and storage stability may be deteriorated in some cases. When the ratio of the dispersant is too large, electrostatic property, particularly environmental stability, of the toner may be deteriorated in some cases. In addition, as a dispersant, a dispersant most suitable for the kind of the releasing agent may be selected from among exemplified dispersants which can be used in the aforementioned coloring agent.

—Method for Producing Toner—

Next, a method for producing the toner of the invention will be explained. The method for producing the toner of the invention is a method utilizing a so-called emulsion polymerization aggregation method comprising an aggregating step of aggregating (the term "aggregating" also includes the case where particles are adhered to aggregated particles which have been once formed by aggregation) one or more kind of particles in a raw material dispersion including the particles, to form aggregated particles, and a coalescing step of coalescing the aggregated particles by heating.

For preparing a raw material dispersion used in the aggregating step, at least a resin particle dispersion in which resin particles including the aforementioned amorphous polyester resin is dispersed is used. Besides this, a coloring agent dispersion is also used, and further, if necessary, various particle dispersions such as a releasing agent dispersion may be used.

One embodiment of the method for producing the toner of the invention is a method for producing a toner in which the raw material dispersion is prepared by mixing two or more kinds of particle dispersions each including one kind of particles, at least one kind of the particle dispersions includes a surfactant, and the resin particle dispersion in which the resin particles including the aforementioned amorphous polyester resin particles are dispersed does not include a surfactant.

Upon production of the toner of the invention, production may be performed by combining steps other than an aggregating step and a coalescing step. A second aggregating step (hereinafter, referred to as an "adhering step") of further adding a resin particle dispersion to a raw material dispersion containing aggregated particles after performance of the aggregating step, mixing them, and forming aggregated particles with resin particles further adhered to a surface thereof (hereinafter, referred to as "adhered aggregated particles") using the aggregated particles obtained by the aggregating step (hereinafter, referred to as "core aggregated particles" in some cases) as a nucleus may be provided.

In the adhering step, in addition to resin particles, releasing agent particles, and coloring agent particles may be combined and may be adhered to an aggregated particle surface. Particles to be adhered to an aggregated particle surface in the adhering step is hereinafter referred to as "additional particles" in some cases.

When the adhering step is provided, at least one of resin particles used in formation of core aggregated particles, and resin particles used in formation of adhered aggregated particles (additional particles) may be resin particles including the aforementioned amorphous polyester resin, and it is particularly preferable that both are resin particles including the amorphous polyester resin.

Each step of a process for a preparing the toner of the invention such as an aggregating step, an adhering step, and a coalescing step will be explained below in more detail.

—Aggregating Step—

In an aggregating step, various particle dispersions are mixed to prepare a raw material dispersion and, thereafter, its pH is adjusted to an acidic region of preferably around 2 to 5, and more preferably around 2.5 to 4. Subsequently, a raw material dispersion after pH adjustment is heated to a temperature which is a temperature around a glass transition temperature of a binder resin used in a resin particle dispersion and is not higher than a glass transition temperature, to aggregate the particles to form aggregated particles.

For forming aggregated particles, an aggregating agent may be added to a raw material dispersion. Examples of an aggregating agent to be used include a surfactant having polarity which is reverse to that of a surfactant used in a dispersant of various particle dispersions, and an inorganic metal salt such as a general inorganic metal compound or a polymer thereof.

A metal element contained in an inorganic metal salt is an element having di- or more-valent charge belonging to 2A, 3A, 4A, 5A, 6A, 7A, 8, 1B, 2B, and 3B Groups in Periodic Table (long-form periodic table), and is dissolved as a form of an ion in an aggregating system of resin particles.

Examples of a preferable inorganic metal salt include metal salts such as calcium chloride, calcium nitrate, barium chloride, magnesium chloride, zinc chloride, aluminum chloride, and aluminum sulfate, inorganic metal salt polymers such as polyaluminum chloride, polyaluminum hydroxide, and calcium polysulfide. Among them, particularly, an aluminum salt and its polymer are preferable.

Generally, in order to obtain a sharper particle size distribution, a valence number of an inorganic metal salt is more suitably divalent than monovalent, and more suitably tri- or more-valent than divalent and, even at the same valence number, a polymerization type inorganic metal salt polymer is more suitable. Upon preparation of the toner of the invention, it is preferable to use an aggregating agent in an aggregating step in that, by varying an aggregating force between materials by these valence number and addition amount, viscoelasticity of the toner can be controlled, and stability of particles can be improved and a particle size distribution can be made to be sharp.

It is preferable that at least one kind metal element selected from aluminum, zinc and calcium contained in the toner of the invention is added as an aggregating agent in a process for preparing the toner. An amount of an aggregating agent to be added varies depending on a kind and a valence number of an aggregating agent, and roughly may be 0.05 to 0.1% by weight. All addition amount of an aggregating agent does not remain in a toner due to elution out into an aqueous medium, or formation of a crude powder in a process for preparing a toner.

—Adhering Step—

After the aggregating step is performed, a coalescing step described later is performed, and an adhering step may be performed prior to the coalescing step.

In the adhering step, a method of adding and mixing a particle dispersion such as a resin particle dispersion to a raw material dispersion in which core aggregated particles are formed is not particularly limited and, for example, the method may be performed continuously, or at a stepwise manner by dividing into a plurality of times. Like this, by adding and mixing additional particles, generation of particles can be suppressed, and a particle size distribution of the resulting toner for electrostatic charge developing can be made to be sharper, contributing to a higher image quality. In addition, by providing an adhering step, a mimic shell structure can be formed, exposure of an internal additive such as a coloring agent and a releasing agent on a toner surface can be reduced and, consequently, electrostatic property and a lifetime of a toner can be improved. Therefore, it is preferable that when a releasing agent is used, additional particles including resin particles as a main component are added.

When this method is used, in a coalescing step, a toner shape can be easily controlled by adjusting a temperature, a stirring number, and a pH.

—Coalescing Step—

In a coalescing step, by bringing a pH of a suspension containing aggregated particles into a range of 5 to 10 under stirring as in the aggregating step, progression of aggregation is stopped, heating is performed at a temperature equal to or higher than a glass transition temperature of an amorphous polyester resin, and thereby, aggregated particles are coalesced.

A heating temperature may be any temperature as far as it is equal to or higher than a glass transition temperature of the amorphous polyester resin. When a binder resin having a higher glass transition temperature or a higher melting point is used together with the amorphous polyester resin, heating is performed at these temperatures or higher (in the following explanation, even when two or more kinds of binder resins are used, explanation will be given presuming that a glass transition temperature of the amorphous polyester resin is the highest).

A time for heating may be such that coalescing is sufficiently done, and may be about 0.2 to 10 hours. Thereafter, when a temperature is lowered to a glass transition temperature of the polyester resin or lower, and coalesced particles are solidified, a particle shape and surface property may be changed depending on a temperature-lowering rate in some cases. For example, when a temperature is lowered at a rapid rate, a shape is easily changed into a sphere, and a surface easily becomes smooth. Conversely, when a temperature is slowly lowered, a shape of particles becomes indeterminate, and irregularities are easily generated on a particle surface. For this reason, it is preferable that a temperature is lowered at a rate of 0.5° C./min or higher, preferably at a rate of 1.0° C./min or higher.

—Washing and Drying Step—

After the coalescing step is completed, toner particles included in a toner slurry is washed and dried to obtain a toner. When electrostatic property of a toner is taken into consideration, it is preferable to perform sufficient replacement washing with ion-exchanged water, and a degree of washing is generally monitored by conductivity of a filtrate, and it is preferable to perform washing so that conductivity becomes finally 30 mS or less.

Washing may include a step of neutralizing an ion with an acid or an alkali, it is preferable that treatment with an acid is performed at a pH of 4.0 or lower, and treatment with an alkali is performed at a pH of 8.0 or higher. In addition, solid liquid separation after washing is not particularly limited, but from a viewpoint of productivity, suction filtration, pressure filtration, or the like are preferably used.

Further, a method of drying is not particularly limited, but from a viewpoint of productivity, lyophilization, flash jet drying, flowing drying, vibration-type flowing drying, or the like is preferably used, and drying is performed so that a final moisture content of a toner is preferably 1% by weight or less, more preferably 0.7% by weight or less.

In addition, upon preparation of the toner of the invention, since a resin particle dispersion containing no surfactant (or if contained, a smaller amount of a surfactant is contained as compared with a conventional case) is used, an amount of a surfactant remaining in a toner slurry obtained via the coalescing step can be made smaller than in a conventional case. For this reason, even when washing is performed to the same extent as has conventionally been performed, an amount of a surfactant remaining in a toner obtained via a washing and drying step can be reduced.

—Additive—

An additive including inorganic particles or organic particles may be added internally and/or externally to the toner of the invention. By reinforcing effect of the additive, a storage modulus of the toner is increased, and offset resistance and peelability from a fixing equipment can be improved in some cases. In addition, an additive improves dispersing property of an internal additive such as a coloring agent and a releasing agent, in some cases.

As inorganic particles, silica, hydrophobicized silica, alumina, titanium oxide, calcium carbonate, magnesium carbonate, tricalcium phosphate, colloidal silica, alumina-treated colloidal silica, cation surface-treated colloidal silica, and anion surface-treated colloidal silica can be used alone, or in combination of two or more. Inter alia, from a viewpoint of OHP transparency and dispersibility in the toner, it is preferable to use colloidal silica. It is preferable that a particle diameter thereof is 5 to 50 nm.

In addition, it is possible to use particles having different particle diameters. The inorganic particles may be directly added at preparation of the toner, but in order to enhance dispersibility, a dispersion in which inorganic particles are dispersed in a water-soluble medium such as water using an ultrasound dispersing machine in advance is used. In dispersing, dispersibility may be improved using an ionic surfactant, a polymer acid, or a polymer base.

Besides, the known material such as a charge controlling agent may be added to the toner of the invention. Thereupon, it is necessary that a volume average particle diameter of a material to be added is 1 μm or smaller, preferably 0.01 to 1 μm.

When the volume average particle diameter exceeds 1 μm, a particle diameter of distribution of the finally obtained toner for electrostatic charge developing may be widened, free particles may be generated, and performance and reliability may be deteriorated in some cases.

On the other hand, when a volume average particle diameter is within the aforementioned range, not only there is no aforementioned defect, but also a variance between toner is reduced, and it is advantage that dispersibility in a toner is better, and a scatter in performance and reliability becomes smaller. A volume average particle diameter can be measured, for example, using a MICROTRACK.

A means for preparing the aforementioned various additive dispersions is not particularly limited, but examples include the known per se dispersing devices such as the same devices as that for preparing a coloring agent dispersion or a releasing agent dispersion, such as a rotation shearing-type homogenizer, and a ball mill, a sand mill, a dyno mill having media, and an optimal means can be used by appropriate selection.

As a flow-improving agent, a cleaning assistant, or an abrasive, inorganic particles and/or organic particles may be externally added to the toner obtained via a washing and drying step.

Examples of inorganic particles include all particles which are usually used as an external additive for a toner surface, such as silica, alumina, titanium oxide, calcium carbonate, magnesium carbonate, tricalcium phosphate, and cerium oxide. It is preferable that these inorganic particles have a hydrophobized surface, and are used for controlling various properties of the toner such as electrostatic property, powder properties, and storability, and system suitability such as developability and transferring property.

Examples of organic particles include all particles which are usually used as an external additive for a toner surface, such as a vinyl-based resin (for example, a styrene-based polymer, an (meth)acryl-based polymer, and an ethylene-based polymer), a polyester resin, a silicone resin, and a fluorine-based resin. These particles are added for the purpose of improving transferring property, and it is preferable that its primary particle diameter is around 0.05 to 1.0 μm.

Further a lubricant may be added. Examples of the lubricant include fatty acid amide such as ethylenebisstearic acid amide, and oleic acid amide, fatty acid metal salt such as zinc stearate, and calcium stearate, and higher alcohol such as unilin. These are generally added for the purpose of improving cleanability, and it is preferable that its primary particle diameter is around 0.1 to 5.0 μm.

In the toner of the invention, it is preferable that, among the aforementioned inorganic particles, at least two kinds of external additives are used, and at least one kind of the external additives has a volume average particle diameter of 30 nm to 200 nm, more preferably 30 nm to 180 nm.

Since a non-electrostatic adhering force with a photoreceptor (latent image holding member) is increased by reduction in a particle diameter of the toner, worse transference and image missing called hollow character may be caused, and may cause a generation of a transference scatter such as image overlapping. Therefore, it is preferable that transferring property is improved by adding an external additive having a large diameter of 30 nm to 200 nm.

When the volume average particle diameter of the external additive is smaller than 30 nm, although initial fluidity of a toner is better, a non-electrostatic adhering force between a toner and a photoreceptor may not be sufficiently reduced, a transferring efficiency may be deteriorated, increase in image missing and deterioration in uniformity of an image may be caused and, additionally, particles may be buried in a toner surface due to a stress in a developing machine with time, electrostatic property may be changed, and a problem such as reduction in a copy density and fog on a background portion may be caused in some cases. When a volume average particle diameter is larger than 200 nm, particles may be easily peeled from a toner surface, and fluidity may be deteriorated in some cases.

Specifically, silica, alumina, and titanium oxide are preferable and, particularly, it is preferable to add hydrophobized silica. In particular, it is preferable to utilize a combination of silica and titanium oxide. In addition, it is also preferable to use organic particles having a volume average particle diameter of 80 to 500 nm in combination with the inorganic particles for improving transferring property.

Examples of the hydrophobizing agent for hydrophobicization-treating inorganic particles used as an external additive include the known materials, such as treatment with coupling agents such as a silane-based coupling agent, a titanate-based coupling agent, an aluminate-based coupling agent, and a zirconium-based coupling agent, a silicone oil or polymer coating. These hydrophobizing agents may be used alone, or in a combination thereof.

Among them, a silane-based coupling agent and a silicone oil can be preferably used. As a silane-based coupling agent, any type of chlorosilane, alkoxysilane, silazane, and special silylating agent can be used.

Examples include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, ethyltrimethoxysilane, propyltrimethoxysilane, phenyltrimethoxysilane, diphenyldimethoxysilane, tetraethoxysilane, methyltriethoxysilane, dimethyldiethoxysilane, ethyltriethoxysilane, propyltriethoxysilane, phenyltriethoxysilane, diphenyldiethoxysilane, butyltrimethoxysilane, butyltriethoxysilane, isobutyltrimethoxysilane, hexyltrimethoxysilane, octyltrimethoxysilane, decyltrimethoxysilane, hexadecyltrimethoxysilane, trimethyltrimethoxysilane, hexamethyldisilazane, N,O-(bistrimethylsilyl)acetamide, N,N-bis(trimethylsilyl)urea, tert-butyldimethylchlorosilane, vinyltrichlorosilane, vinyltrimethoxysilane, vinyltriethoxysilane, vinyltriacetoxysilane, γ-methacryloxypropyltrimethoxysilane, β-(3,4epoxycyclohexyl)ethyltrimethoxysilane, γ-glycidoxypropyltrimethoxysilane, γ-glycidoxypropyltriethoxysilane, γ-glycidoxypropylmethyldiethoxysilane, γ-mercaptopropyltrimethoxysilane, γ-chloropropyltrimethoxysilane and the like, fluorine-based silane compounds thereof in which a part of hydrogen atoms are substituted with fluorine atoms, such as trifluoropropyltrimethoxysilane, tridecafluorooctyltrimethoxysilane, heptadecafluorodecyltrimethoxysilane, heptadecafluorodecylmethyldimethoxysilane, tridecafluoro-1,1,2,2-tetrahydrooctyltriethoxysilane, 3,3,3-trifluoropropyltrimethoxysilane, heptadecafluoro-1,1,2,2-tetrahydrodecyltriethoxysilane, and 3-heptafluoroisopropoxypropyltriethoxysilane, and amino-based silane compounds in which a part of hydrogen atoms are substituted with amino groups, being not limiting.

As the silicone oil, a dimethylsilicone oil, a methylhydogensilicone oil, a methylphenylsilicone oil, a cyclic dimethylsilicone oil, an epoxy-modified silicone oil, a carboxyl-modified silicone oil, carbinol-modified silicone oil, a methacryl-based silicone oil, a mercapto-modified silicone oil, a polyether-modified silicone oil, a methylstyryl-modified silicone oil, an alkyl-modified silicone oil, an amino-based silicone oil, and a fluorine-modified silicone oil can be used, being not limiting.

When hydrophobized external additive particles are used, an amount of electrostatic charge under high humidity can be improved and, consequently, environmental stability of electrification can be improved. In the toner of the invention, it is preferable that at least one kind external additive which has been silicone oil-treated is contained.

As a method of hydrophobization-treating external additive particles, the conventional method such as a method of adding a treating agent obtained by mixing and diluting with a solvent such as tetrahydrofuran, toluene, ethyl acetate, methyl ethyl ketone, and acetone dropwise to external additive particles obtained by forcible stirring with a blender, or spraying the treating agent to sufficiently mix the material, if necessary, washing and filtering it, thereafter, heating and drying this, and grinding aggregated materials with a blender or a mortar after drying, a method of immersing external additive particles in a solution of a treating agent in a solvent, and drying this, or dispersing external additive particles in water into a slurry, adding dropwise a treating agent solution and, thereafter, settling external additive particles, heating, drying and grinding particles, and a method of directly spraying a treating agent to external additive particles can be used.

An amount of the treating agent to be adhered to external additive particles is preferably 0.01 to 50% by weight, more preferably 0.1 to 25% by weight relative to external additive particles. Regarding an adhering amount, a treatment amount can be changed by a method of increasing a mixing amount of a treating agent at a treating stage, or changing a washing step number after treatment.

An adhering amount of a treating agent can be determined by XPS (X-ray photoelectron spectroscopy) or elementary analysis. When an adhering amount of a treating agent is small, electrostatic property under high humidity may be reduced in some cases and, when a treating amount is too large, electrification under low humidity may become excessive, or a free treating agent may deteriorate powder fluidity of a developer in some cases.

The external additive is adhered or fixed to a toner particle surface by applying a mechanical impact force to the external additive together with toner particles with a sample mill or a HENSCHEL mixer.

(Developer for Electrostatic Charge Developing)

The developer for electrostatic charge developing of the invention (hereinafter, referred to as "developer" in some cases) contains the aforementioned toner of the invention, examples thereof include a one-component developer consisting only of a toner, and a two-component developer containing a toner and a carrier. A two-component developer, which is excellent in maintenance and stability of electrification is preferable. As a carrier, a carrier covered with a resin is preferable, and a carrier covered with a nitrogen-containing resin is more preferable.

Examples of the nitrogen-containing resin include an acryl-based resin including dimethylaminoethyl methacrylate, dimethylacrylamide, and acrylonitrile, an amino resin including urea, urethane, melamine, guanamine, and aniline, an amide resin, and a urethane resin. Alternatively, copolymerized resins thereof may be used.

Two or more kinds among the aforementioned nitrogen-containing resins may be used in combination. Alternatively, the nitrogen-containing resin and a resin not containing nitrogen may be used in combination. Alternatively, the nitrogen-containing resin is finely-divided, and dispersed in a resin not containing nitrogen, which may be used. In particular, since a urea resin, a urethane resin, a melamine resin, and an amide resin have high negative electrostatic property, and have a high resin hardness, reduction in an amount of electrostatic charge due to peeling of a covering resin can be suppressed, being preferable. Generally, it is necessary that a carrier has a suitable electric resistance. Specifically, an electric resistance value of the carrier is preferably around $10^9$ to $10^{14}$ Ωcm.

For example, when an electric resistance value is low as $10^6$ Ωcm as in iron powder carrier, a problem may arise in some cases that a carrier is adhered to an image part of a photoreceptor due to charge injection through a sleeve, a latent image charge is escaped mediated with a carrier, and distortion of a latent image and default of an image are caused.

On the other hand, when an insulating resin is thickly covered, an electric resistance value becomes too high, and a carrier charge is leaked with difficulty and, as a result, an image effective in an edge is obtained, but a problem of edge effect that an image density at a central part becomes very low at an image surface having a large area may be caused in some cases. For this reason, it is preferable to disperse an electrically conductive powder in a resin covering layer in order to adjust a resistance of a carrier.

Examples of the electrically conductive powder include a metal such as gold, silver and copper; carbon black; semi-electrically conductive oxide such as titanium oxide, and zinc oxide; a powder in which a surface of titanium oxide, zinc oxide, barium sulfate, aluminum borate or potassium titanate powder is covered with tin oxide, carbon black, or a metal. Among them, from a viewpoint of manufacturing stability, a cost, and higher electrical conductivity, carbon black is preferable.

Examples of a method of forming the resin covering layer on a surface of a carrier core material include an immersion method of immersing a powder of a carrier core material in a solution for forming a covering layer, a spraying method of spraying a solution for forming a covering layer to a surface of a carrier core material, a fluidized bed method of spraying a solution for forming a covering layer in the state where a carrier core material is floated by a flowing air, a kneader coater method of mixing a carrier core material and a solution for forming a covering layer to remove a solvent in a kneader coater, and a powder coating method of finely-dividing a covering resin, mixing this and a carrier core material at a melting point of a covering resin or higher in a kneader coater, and cooling the mixture to make a film. A kneader coater method and a powder coating method are particularly preferably used. An average film thickness of a resin covering layer formed by the aforementioned method is usually in a range of 0.1 to 10 μm, preferably 0.2 to 5 μm.

A core material used in a carrier (carrier core material) is not particularly limited, examples include a magnetic metal such as iron, steel, nickel and cobalt, magnetic oxide such as ferrite, and magnetite, and glass beads and, from a viewpoint of use of a magnetic brush method, a magnetic carrier is desirable.

Generally, a volume average particle diameter of a carrier core material is preferably 10 to 100 μm, more preferably 20 to 80 μm. A mixing ratio (weight ratio) of the toner for electrophotography of the invention and the carrier in the aforementioned two-component developer is preferably in a range of around toner:carrier=1:100 to 30: 100, more preferably in a range of around 3:100 to 20:100.

(Image Forming Method)

Then, the image forming method of the invention using the developer of the invention will be explained.

The image forming method of the invention is not particularly limited and any known electrophotography method may be used as far as it can form an image using the developer of the invention. Specifically, the method preferably comprises a latent image forming step of forming an electrostatic latent image on a latent image holding member surface, a developing step of developing the electrostatic latent image formed on the latent image holding member surface using a developer held by a developer holding member to form a toner image, a transferring step of transferring the toner image formed on the latent image holding member surface onto a surface of a recording material such as a paper, and a fixing step of thermally fixing the toner image transferred onto the recording material surface and, therein, as the developer, the developer of the invention is used.

In one embodiment, the developer may be of a one-component system and in another embodiment, the developer may be of a two-component system as described above. In the case of a one-component system, the toner of the invention is used as it is and, in the case of a two-component system, a two-component developer in which the toner of the invention and a carrier are mixed is used.

As the each aforementioned step, the step known in an image forming method can be utilized in all cases. The image forming method may include other steps such as a so-called intermediate transferring step in which transferring of a toner image from the latent image holding member surface onto a recording medium surface is performed via an intermediate transferring body.

As the latent image holding member, for example, an electrophotographic photoreceptor or a dielectric recording body may be used.

In the case of the electrophotographic photoreceptor, a surface of the electrophotographic photoreceptor is uniformly charged with a corotron electrifier or a contact electrifier, and is exposed to light to form an electrostatic latent image (latent image forming step). Then, by contacting with or bringing in vicinity of a developing roll having a surface on which a developer layer is formed (developer holding member), toner particles are adhered to the electrostatic latent image, to form a toner image on the electrophotographic photoreceptor (developing step). The formed toner image is transferred onto a surface of a recording medium such as a paper (transferring step). Further, the toner image transferred onto the recording medium surface is thermally fixed with a fixing device to form a final toner image.

EXAMPLES

The present invention will be explained in detail below by way of Examples, but the invention is not limited to them.

Summary of preparation of the toner in the following Examples is as follows: First, each of the following resin particle dispersion, coloring agent dispersion, and releasing agent dispersion is prepared, and a metal salt aggregating agent is added to be ionically neutralized, while these are stirred and mixed at a prescribed ratio, to form aggregated particles. Then, inorganic hydroxide is added to adjust a pH in a raw material dispersion from a weak acidic region to neutral region, and this is heated to a temperature of a glass transition point of resin particles or higher to coalesce particles. After coalescing treatment, a desired toner is obtained via steps of sufficient washing, solid liquid separation, and drying. A method of preparing each of them will be explained below.

[Measurement of Molecular Weight]

A weight average molecular weight and a number average molecular weight of an amorphous polyester resin used in preparation of a toner, which will be explained below are measured under the following condition.

As a measuring apparatus, HLC-8120GPC, SC-8020 (trade name, manufactured by Tosoh Corporation) is used, as a column, TSK gel, SuperHM-H (6.0 mmID×15 cm×2) (trade name, manufactured by Tosoh Corporation) is used and, as an eluent, THM (tetrahydrofuran) is used.

Measuring conditions are a sample concentration 0.5%, a flow rate 0.6 ml/min., a sample injection amount 10 μl, and a measuring temperature 40° C., and a calibration line is produced from ten samples of A-500, F-1, F-10, F-80, F-380, A-2500, F-4, F-40, F-128, and F-700. A data collecting interval in sample analysis is 300 ms.

—Preparation of Amorphous Polyester Resin Dispersion—

As an acid component (polyvalent carboxylic acids) and an alcohol component (polyhydric alcohols), respective materials are placed into a reactor equipped with a stirrer, a thermometer, a condenser, and a nitrogen gas introducing tube at a material compositional ratio (mole ratio) shown in the following Table 1, the interior of the reactor is replaced with a dry nitrogen gas, 0.04 mole of dibutyltin oxide is placed, these are stirred and reacted at about 195° C. for about 6 hours under a nitrogen gas stream, a temperature is further raised to about 240° C. to stir and react the materials for about 6.0 hours, a pressure of the reactor is reduced to 10.0 mmHg, and the materials are stirred and reacted for about 0.5 hour under reduced pressure, to obtain a pale yellow transparent linear amorphous polyester resin (1) to (10).

TABLE 1

| Resin constituent material | Kind of amorphous polyester resin | | | | | | | | | |
|---|---|---|---|---|---|---|---|---|---|---|
| (mole ratio) | Resin (1) | Resin (2) | Resin (3) | Resin (4) | Resin (5) | Resin (6) | Resin (7) | Resin (8) | Resin (9) | Resin (10) |
| Acid component | | | | | | | | | | |
| SDSP*1 | 0.2 | 5 | 10 | — | 5 | 10 | 0.2 | 5 | 0.1 | 12 |
| Terephthalic acid | 59.8 | 55 | 50 | 60 | 55 | 50 | 59.8 | 55 | 49.9 | 58 |

TABLE 1-continued

| Resin constituent material | Kind of amorphous polyester resin | | | | | | | | | |
|---|---|---|---|---|---|---|---|---|---|---|
| (mole ratio) | Resin (1) | Resin (2) | Resin (3) | Resin (4) | Resin (5) | Resin (6) | Resin (7) | Resin (8) | Resin (9) | Resin (10) |
| Isophthalic acid | 40 | — | 40 | 40 | — | 40 | 40 | 40 | 50 | 30 |
| Fumaric acid | — | 40 | — | — | 40 | — | — | — | — | — |
| Alcohol component | | | | | | | | | | |
| BPA-EO*2 | 25.5 | 54 | 30 | 25.5 | — | 85.5 | 90 | 85 | 54 | 40 |
| BPA-PO*3 | 59.5 | 36 | 40 | 59.5 | 90 | 4.5 | — | 10 | 36 | 50 |
| Ethylene glycol | 15 | 10 | — | 15 | — | 10 | 10 | 5 | 10 | 10 |
| Cyclohexanedimethanol | — | — | 30 | — | 10 | — | — | — | — | — |
| SDSP/total components (mol %) | 0.1 | 2.5 | 5.0 | 0 | 2.5 | 5.0 | 0.1 | 2.5 | 0.05 | 6.0 |
| BPA-EO/BPA-PO (mole ratio) | 0.43 | 1.50 | 0.75 | 0.43 | 0 | 19 | — | 8.50 | 1.50 | 0.80 |

*1dimethyl isophthalate-5-sodiumsulfonate
*2bisphenol A ethylene oxide 1 mol adduct
*3bisphenol A propylene oxide 1 mol adduct Then, the resulting amorphous polyester resin (1) to (10) is dispersed using a dispersing machine in which Cavitron CD1010 (trade name, manufactured by Eurotec) is modified into a high temperature and high pressure-type. At a compositional ratio of 80% by weight of ion-exchanged water, and 20% by weight of an amorphous polyester resin, a pH is adjusted to 8.5 with ammonia, and Cavitron is operated under the conditions of a rotating rate of a rotor of 60 Hz, a pressure of 5 Kg/cm$^2$, and heating 140° C. with heat exchanger, to obtain an amorphous polyester resin dispersion (1) to (10).

In addition, upon preparation of an amorphous polyester resin dispersion (1) to (10), only regarding (4) a dispersion of an amorphous polyester resin synthesized without using carboxylic acid containing a sulfonic acid group, and (9) a dispersion of an amorphous polyester resin synthesized using carboxylic acid containing a sulfonic acid group only at a mole ratio of 0.1, a surfactant (sodium dodecylbenzenesulfonate) is added, respectively, at 5% by weight and 0.5% by weight relative to a total amount of a dispersion, and dispersions other than these are prepared without using a surfactant, and dispersion stability of resin particles is good in all dispersions.

A molecular weight of the resulting amorphous polyester resin (1) to (10), a volume average particle diameter, and a pH of a resin particle dispersion (1) to (10), and an amount of a surfactant in a resin particle dispersion are shown in Table 2. A volume average particle diameter (volume average particle diameter D50v) shown in Table 2 is measured with MICROTRACK UPA.

—Preparation of Coloring Agent Dispersion—

Using 20 parts by weight of a cyan pigment (trade name: ECB-301, manufactured by Dainichiseika Color & Chemicals Mfg. Co., Ltd.), 2 parts by weight of an anionic surfactant (trade name: Neogen SC, manufactured by Dai-ichi Kogyo Seiyaku Co., Ltd.; as active ingredient, 10% by weight relative to coloring agent), and 78 parts by weight of ion-exchanged water, the components are placed into a stainless container having such a size that a height of a liquid surface becomes around ⅓ a height of a container when all are placed therein, and components are dispersed at 5000 rpm for 5 minutes using a homogenizer (trade name: Ultra-Turrax T50, manufactured by IKA Japan K.K.), and stirred with a stirring equipment overnight to defoam this.

Subsequently, the resulting dispersion is dispersed at a pressure of 240 MPa using a high pressure impact-type dispersing machine (trade name: Ultimizer HJP30006, manufactured by Sugino Machine Limited). Dispersing is performed at 25 pass equivalence based on a total charging amount and a processing capacity of an apparatus. Thereafter, ion-exchanged water is added to adjust a solid matter concentration to 15.0% by weight.

When an average particle diameter of the resulting coloring agent dispersion is measured with MICROTRACK UPA, a volume average particle diameter D50v is 15 nm.

—Preparation of Releasing Agent Dispersion—

Carnauba wax (melting point 81° C.: 45 parts by weight)

TABLE 2

| | Resin (1) | Resin (2) | Resin (3) | Resin (4) | Resin (5) | Resin (6) | Resin (7) | Resin (8) | Resin (9) | Resin (10) |
|---|---|---|---|---|---|---|---|---|---|---|
| Weight average molecular weight | 15000 | 30000 | 27000 | 10000 | 50000 | 18000 | 25000 | 12000 | 23000 | 10500 |
| Number average molecular weight | 5500 | 12000 | 11000 | 4500 | 23000 | 7200 | 9700 | 4800 | 9700 | 3900 |
| Volume average particle diameter (nm) | 80 | 125 | 110 | 150 | 130 | 100 | 140 | 110 | 125 | 100 |
| pH | 7.9 | 6.8 | 7.3 | 7.5 | 6.9 | 7.7 | 7.2 | 6.8 | 7.2 | 6.9 |
| Amount of surfactant in resin particle dispersion (weight %) | 0 | 0 | 0 | 5.0 | 0 | 0 | 0 | 0 | 0.5 | 0 |

Cationic surfactant (trade name: Neogen RK, manufactured by Dai-ichi Kogyo Seiyaku Co., Ltd.: 5 parts by weight Ion-exchanged water: 200 parts by weight The above components are heated to 95° C., sufficiently dispersed with Ultra-Turrax T50 manufactured by IKA Japan K.K., dispersing-treated with a pressure discharge-type Gaulin homogenizer and, thereafter, ion-exchanged water is added to adjust a solid matter concentration to 25.0% by weight.

When an average particle diameter of the resulting releasing agent dispersion is measured with MICROTRACK UPA, a volume average particle diameter D50v is 200 nm.

Example 1

Ion-exchanged water: 410 parts by weight

Amorphous polyester resin dispersion (1): 450 parts by weight

The above components are placed into a 3 liter reactor equipped with a thermometer, a pH meter, and a stirrer, and they are retained at a temperature of 30° C. for 30 minutes at a stirring rotation speed of 150 rpm while a temperature is controlled with a mantle heater from the outside.

Thereafter, the following components are placed, and retained for 5 minutes. At that state, a 1.0 weight % aqueous nitric acid solution is added to adjust a pH to 2.7.

Coloring agent dispersion: 50 parts by weight (coloring agent concentration 15% by weight)

Releasing agent dispersion: 60 parts by weight (releasing agent concentration 25% by weight)

Subsequently, a stirrer, and a mantle heater are removed, a solution containing the following components are added at ½ a total amount while they are dispersed at 3000 rpm with a homogenizer (Ultra-Turrax T50 manufactured by IKA Japan K.K.), ½ of a remainder is added at a dispersing rotation speed of 5000 rpm over 1 minute, and this is dispersed at a dispersing rotation speed of 6500 rpm for 6 minutes.

polyaluminum chloride: 0.33 parts by weight 0.1 weight % aqueous nitric acid solution: 37.5 parts by weight A stirrer, and a mantle heater are mounted in a reactor, a temperature is raised to 42° C. at 0.5° C./min. while a rotation speed of a stirrer is appropriately adjusted so that a slurry is sufficiently stirred, and a temperature is retained at 42° C. for 15 minutes and, thereafter, a particle diameter is measured with a COULTER COUNTER (model TA-II, aperture diameter: 50 μm, manufactured by Beckman-Coulter) every 10 minutes while a temperature is raised at 0.05° C./min.

At a time point where a volume average particle diameter D50v of core aggregated particles becomes 5.0 μm, 200 parts by weight of an amorphous polyester resin dispersion (1) is added over 3 minutes. A temperature is retained for 30 minutes after the adding, a pH is adjusted to 9.0 using a 5 weight % aqueous sodium hydroxide solution.

Thereafter, a temperature is raised to 96° C. at a temperature raising rate of 1° C./min. while a pH is adjusted to 9.0 every 5° C., and retained at 96° C. When a particle shape and surface property are observed with a optical microscope and a scanning electron microscope (FE-SEM) every 30 minutes, a shape is converted into an approximately spherical shape at 3 hours, a temperature is lowered to 20° C. at 1° C./min. to solidify particles, to obtain a toner slurry containing toner particles.

Thereafter, toner particles obtained by filtering the toner slurry are washed with ion-exchanged water and, when conductivity of a filtrate becomes 50 mS or less, toner particles which become cake-like are taken out, placed into a 10-fold amount a particle weight of ion-exchanged water, this is stirred with a three one motor and, when cake-like toner particles are sufficiently loosened, a pH is adjusted to 3.8 with a 1.0 weight % aqueous nitric acid solution, and this is retained for 10 minutes.

Thereafter, filtration and water washing are performed again and, at a time point where conductivity of a filtrate becomes 10 mS or lower, water flow is stopped, and solid liquid separation is performed. The resulting cake-like toner particles are ground with a sample mill, and dried in an oven at 40° C. for 24 hours. The resulting powder is ground with a sample mill, and dried under vacuum in an oven at 40° C. for 5 hours to obtain a toner.

1.5 Parts by weight of hydrophobic silica (trade name: RY50, manufactured by Nippon Aerosil) and 1.0 part by weight of hydrophobic titanium oxide (trade name: T805, manufactured by Nippon Aerosil) relative to 100 parts by weight of the resulting toner are mixed and blended at 10000 rpm for 45 seconds using a sample mill. Thereafter, the blend is sieved with a vibration sieve having an opening of 45 μm to prepare a toner (1).

Example 2

A toner (2) is obtained in the same manner as in Example 1 except that the amorphous polyester resin dispersion (1) is changed to an amorphous polyester resin dispersion (2).

Example 3

A toner (3) is obtained in the same manner as in Example 1 except that the amorphous polyester resin dispersion (1) is changed to an amorphous polyester resin dispersion (3).

Example 4

A toner (8) is obtained in the same manner as in Example 1 except that the amorphous polyester resin dispersion (1) is changed to an amorphous polyester resin dispersion (8).

Example 5

A toner (9) is obtained in the same manner as in Example 1 except that the amorphous polyester resin dispersion (1) is changed to an amorphous polyester resin dispersion (9).

Example 6

A toner (10) is obtained in the same manner as in Example 1 except that the amorphous polyester resin dispersion (1) is changed to an amorphous polyester resin dispersion (10).

Comparative Example 1

A raw material dispersion is prepared in the same manner as in Example 1 except that the amorphous polyester resin dispersion (1) is changed to an amorphous polyester resin dispersion (4).

However, after preparation of a raw material dispersion, at a stage at which a pH of the dispersion is adjusted to 2.7, since dispersed resin particles are aggregated to form a gel unless a surfactant is used, 3.5 parts by weight of an anionic surfactant (trade name: Neogen RK, manufactured by Dai-ichi Kogyo Seiyaku Co., Ltd.; active ingredient amount 60% by weight) is additionally added to the raw material dispersion at room temperature, this is stirred for 30 minutes, and a pH is adjusted to 2.7. Aside from this, a toner (4) is obtained in the same manner as in Example 1.

Comparative Example 2

A toner (5) is obtained in the same manner as in Example 1 except that the amorphous polyester resin dispersion (1) is changed to an amorphous polyester resin dispersion (5).

Comparative Example 3

A toner (6) is obtained in the same manner as in Example 1 except that the amorphous polyester resin dispersion (1) is changed to an amorphous polyester resin dispersion (6).

Comparative Example 4

A toner (7) is obtained in the same manner as in Example 1 except that the amorphous polyester resin dispersion (1) is changed to an amorphous polyester resin dispersion (7).

An average particle diameter and a particle size distribution of the toner obtained as described above are shown in Table 3.

In Table 3, average particle diameter distribution indices (D84v/D50v, D50p/D16p) mean that 1.0 is monodisperse and, as a numerical value becomes larger, a distribution is widened. In a particle size distribution of a toner, D84v/D50v indicates a distribution of a crude powder side, and D50p/D16p indicates a distribution of a fine powder side.

TABLE 3

| | Example 1 | Example 2 | Example 3 | Example 4 | Example 5 | Example 6 | Comparative Example 1 | Comparative Example 2 | Comparative Example 3 | Comparative Example 4 |
|---|---|---|---|---|---|---|---|---|---|---|
| Volume average particle diameter (D50v) | 5.8 μm | 6.3 μm | 6.1 μm | 6.1 μm | 5.9 μm | 6.0 μm | 5.7 μm | 6.8 μm | 6.3 μm | 6.3 μm |
| Number average particle diameter (D50p) | 4.9 μm | 5.6 μm | 5.3 μm | 5.0 μm | 5.0 μm | 5.1 μm | 4.3 μm | 4.9 μm | 5.2 μm | 5.1 μm |
| Volume average particle diameter distribution (D84v/D50v) | 1.23 | 1.22 | 1.23 | 1.22 | 1.22 | 1.20 | 1.31 | 1.33 | 1.32 | 1.33 |
| Number average particle diameter distribution (D50p/D16p) | 1.24 | 1.22 | 1.23 | 1.24 | 1.25 | 1.22 | 1.35 | 1.38 | 1.34 | 1.37 |
| Fine powder amount (*) | 1.2 number % | 0.9 number % | 1.1 number % | 2.0 number % | 1.5 number % | 0.5 number % | 12.5 number % | 9.2 number % | 8.5 number % | 7.0 number % |

*Ratio of the number of particles having a number average particle diameter D50p of 3 μm or smaller relative to a total particle number In the present specification, a volume average particle diameter D50v, a number average particle diameter D50p, and an average particle size distribution index shown in Table 3 and the like can be measured using a COULTER COUNTER TAII (manufactured by Beckman-Coulter), a MULTISIZER II (manufactured by Beckman-Coulter), or the like.

Specifically, first, accumulated distributions of a volume and a number are delineated from a small diameter side for a particle size range (channel) divided based on particle size distributions measured with these measuring equipments, the particle diameters at accumulation 16% are defined respectively as volume average particle diameter D16v and number average particle diameter D16p, the particle diameters at accumulation 50% are respectively defined as volume average particle diameter D50v and number average particle diameter D50p, and the particle diameters at accumulation 84% are respectively defined as volume average particle diameter D84v and number average particle diameter D84p. Then, by combining these, various volume average particle size distribution indices, and number average particle size distribution indices shown in Table 3 can be calculated.

[Preparation of Carrier]

Ferrite particles (volume average particle diameter 50 μm; 100 parts by weight)

Toluene: 14 parts by weight

Perfluorooctylethyl methacrylate/methacrylate copolymer (copolymerization ratio (mole ratio): 15/85): 2 parts by weight Carbon black (trade name: VXC72, manufactured by Cabbot): 0.2 part by weight First, among the above components, components except for ferrite particles are stirred with a sand mill for 10 minutes to obtain a covering solution, the dispersed covering solution is weighed, then, this covering solution and ferrite particles are placed into a vacuum degassing-type kneader, a pressure is reduced to −20 mmHg at 60° C. while stirring, the materials are mixed for 30 minutes, a temperature is raised/a pressure is reduced, and the mixture is stirred and dried at 90° C./−720 mmHg for 30 minutes to obtain a carrier. This carrier has a volume specific resistance of $10^{11}$ Ωcm at an electric field at application of 1000 V/cm.

[Preparation of Developer]

8 Parts by weight of each toner obtained in Examples and Comparative Examples is blended with 100 parts by weight of the carrier with a V-type blender for 20 minutes, and coarse particles are removed with a vibration sieve having an opening of 212 micron to obtain each of developers (1) to (10).

[Image Assessing Method]

Each of the resulting developers is set in a developing equipment which is a modified DOCUCENTER Color 400 machine (manufactured by Fuji Xerox Co., Ltd.) in an environmental chamber at a room temperature of 32° C. and a humidity of 75%, 50000 pcs. are printed out continuously, and a background portion fog of the resulting image and sharpness of a text image are assessed. As a paper, C2 paper manufactured by Fuji Xerox Office Supply is used, and an image including Japanese letters including 4 point and 6 point Chinese characters is formed.

Fog is assessed with the naked eye and, by comparing with a boundary sample, 5-stage assessment of the following G1 to G5 is performed. Usually, at G1 or G2, it can be judged that there is no problem in image quality.

G1(A): Fog is not observed at all.

G2(A): Fog is observed with a magnifying glass, but there is no practical problem.

G3(B): Fog can be confirmed with the naked eye. This is a problem depending on a customer.

G4(C): Fog is easily observed with the naked eye.

G5(C): Fog is conspicuously observed.

Sharpness of a text image is performed by readability by observation of Japanese letters having different sizes with the naked eye. Assessment criteria are as follows.

A: 4 Point Japanese letters can be read.

B: 6 Point Japanese letters can be read.

C: 6 Point Japanese letters can be read with difficulty, or cannot be read.

Assessment results are shown in Table 4.

TABLE 4

| | Example 1 | Example 2 | Example 3 | Example 4 | Example 5 | Example 6 | Comparative Example 1 | Comparative Example 2 | Comparative Example 3 | Comparative Example 4 |
|---|---|---|---|---|---|---|---|---|---|---|
| Initial | | | | | | | | | | |
| Fog | G1(A) | G1(A) | G1(A) | G1(A) | G1(A) | G1(A) | G3(B) | G2(A) | G2(A) | G2(A) |
| Sharpness | A | A | A | A | A | A | C | B | B | C |
| After printing of 5000 pcs | | | | | | | | | | |
| Fog | G2(A) | G1(A) | G2(A) | G1(A) | G2(A) | G2(A) | G5(C) | G4(C) | G4(C) | G4(C) |
| Sharpness | A | A | A | A | B | B | C | C | C | C |

From Table 3 and Table 4, it is shown that in Examples 1 to 3, a particle size distribution of the resulting toner is extremely sharp and, also in image quality, from an initial stage to even after printing of 50000 pcs., a good condition is maintained with respect to both of fog and sharpness of letters.

On the other hand, in Comparative Example 1, since the amorphous polyester resin does not contain a sulfonic acid group, in the aggregating step, the raw material dispersion is gelled upon adjustment of pH into an acidic region unless a surfactant is used, and in order to prevent gelation, a surfactant is additionally added to the raw material dispersion to prepare the toner. However, a particle size distribution of the resulting toner is wide, and for this reason, a problem arises in image quality from an initial stage.

In Comparative Examples 2 and 3, a ratio of an ethylene oxide adduct of bisphenol A, and a propylene oxide adduct of bisphenol A used in preparing the amorphous polyester resin is changed, and in both of these Comparative Examples, it is difficult to control the sharpness of a particle size distribution at aggregation. In addition, after printing of 50000 pcs., deterioration in both fog and sharpness is observed.

In Comparative Example 4, from among the ethylene oxide adduct of bisphenol A and the propylene oxide adduct of bisphenol A, only the former is used for preparing the amorphous polyester resin. For this reason, hydrophilicity of the amorphous polyester resin becomes too great, and it is difficult to control the sharpness of a particle size distribution. For this reason, from an initial stage, sharpness is poor, and after printing of 50000 pcs., deterioration of fog is also observed.

As explained above, according to the invention, a toner for electrostatic charge developing which can form an image having no fog and excellent resolution over a long period of time by suppressing an amount of a surfactant to be used to an amount that is smaller than that conventionally used to make a particle size distribution of the toner sharp when the toner is prepared by a so-called emulsion polymerization aggregation method utilizing an amorphous polyester resin as a binder resin, a production method thereof, a developer for electrostatic charge developing using the same, and an image forming method can be provided.

What is claimed is:

1. A toner for electrostatic charge developing prepared by a production method comprising aggregating one or more kinds of particles in a raw material dispersion including the particles to form aggregated particles, and coalescing the aggregated particles by heating, wherein at least one kind of the particles is resin particles including an amorphous polyester resin synthesized by copolymerizing one or more polyvalent carboxylic acids and two or more polyhydric alcohols;

at least one of the polyvalent carboxylic acids is a polyvalent carboxylic acid having a sulfonic acid group;

two of the polyhydric alcohols are an ethylene oxide adduct of bisphenol A and a propylene oxide adduct of bisphenol A; and the following equation (1) is satisfied:

$$10/90 \leqq BPA(EO)/BPA(PO) \leqq 90/10 \quad \text{Equation (1)}$$

wherein, BPA(EO) represents a total mole amount of the ethylene oxide adduct of bisphenol A used in synthesis of the amorphous polyester resin, and BPA(PO) represents a total mole amount of the propylene oxide adduct of bisphenol A used in synthesis of the amorphous polyester resin, and wherein the amorphous polyester resin comprises particles having an average particle diameter in a range of between 0.005 μm to 0.5 μm.

2. The toner for electrostatic charge developing of claim 1, wherein a ratio of the polyvalent carboxylic acid having a sulfonic acid group relative to a total amount of the polyvalent carboxylic acids and the polyhydric alcohols used in synthesis of the amorphous polyester resin is in a rangeof 0.1 to 5 mol %.

3. The toner for electrostatic charge developing of claim 1, wherein addition amounts of ethylene oxide and propylene oxide to bisphenol A are each 2 mol or less relative to imol of bisphenol A.

4. The toner for electrostatic charge developing of claim 1, wherein the polyvalent carboxylic acid having a sulfonic acid group is a sodium salt of 5-sulfoisophthalic acid.

5. The toner for electrostatic charge developing of claim 1, wherein a weight average molecular weight (Mw) of the amorphous polyester resin is 5,000 to 500,000.

6. The toner for electrostatic charge developing of claim 1, wherein a ratio of a binder resin other than the amorphous polyester resin relative to a total binder resin is 40% by weight or less.

7. The toner for electrostatic charge developing of claim 1, wherein a content of a coloring agent relative to a weight of a total solid components of the toner is 4 to 15% by weight.

8. The toner for electrostatic charge developing of claim 1, wherein the toner includes a releasing agent.

9. The toner for electrostatic charge developing of claim 8, wherein the releasing agent has a maximum main endothermic peak in the range of 60 to 120° C., and a melt viscosity of 1 to 50 mPa·s at 140° C.

10. The toner for electrostatic charge developing of claim 1, wherein the toner includes inorganic particles.

11. The toner for electrostatic charge developing of claim 10, wherein the inorganic particles are two or more external additives, and one of the external additives has a volume average particle diameter of 30 nm to 200 nm.

12. The toner for electrostatic charge developing of claim 1, wherein the toner includes a hydrophobized silica as an external additive.

13. A developer for electrostatic charge developing, which comprises the toner for electrostatic charge developing of claim 1, and a carrier covered with a resin.

14. The developer for electrostatic charge developing of claim 13, wherein the carrier is covered with a nitrogen-containing resin.

15. The developer for electrostatic charge developing of claim 13, wherein an electric resistance of the carrier is $10^9$ to $10^{14}$ Ωcm.

16. The developer for electrostatic charge developing of claim 13, wherein electrically conductive powder is dispersed in a resin covering layer of the carrier.

17. The developer for electrostatic charge developing of claim 13, wherein a volume average particle diameter of the carrier is 10 to 100 μm.

18. An image forming method comprising:

forming an electrostatic latent image on a latent image holding member surface;

developing the electrostatic latent image formed on the latent image holding member surface with a developer held by a developer holding member to form a toner image;

transferring the toner image formed on the latent image holding member surface onto a recording medium surface; and thermally fixing the toner image transferred onto the recording medium surface, wherein the developer is the developer for electrostatic charge developing of claim 13.

19. The toner for electrostatic charge developing of claim 1, wherein the amorphous polyester resin comprises particles having an average particle diameter in a range of between 0.01 μm to 0.3 μm.

20. A method for producing a toner for electrostatic charge developing comprising:

aggregating one or more kinds of particles in a raw material dispersion including the particles to form aggregated particles, and coalescing the aggregated particles by heating, wherein at least one kind of the particles is resin particles including an amorphous polyester resin synthesized by copolymerizing one or more polyvalent carboxylic acids and two or more polyhydric alcohols, at least one of the polyvalent carboxylic acids is a polyvalent carboxylic acid having a sulfonic acid group, two of the polyhydric alcohols are an ethylene oxide adduct of bisphenol A and a propylene oxide adduct of bisphenol A, and the following equation (1) is satisfied $$10/90 \leqq BPA(EO)/BPA(PO) \leqq 90/10 \quad \text{Equation (1)}$$

wherein BPA(EO) represents a total mole amount of the ethylene oxide adduct of bisphenol A used in synthesis of the amorphous polyester resin, and BPA (PO) represents a total mole amount of the propylene oxide adduct of bisphenol A used in synthesis of the amorphous polyester resin, and wherein the amorphous polyester resin comprises particles having an average particle diameter in a range of between 0.005 μm to 0.5 μm.

21. The method for producing a toner for electrostatic charge developing according to claim 20, wherein the amorphous polyester resin comprises particles having an average particle diameter in a range of between about .01 μm to about 0.3 μm.

* * * * *